US008561793B2

(12) United States Patent
Chatelain

(10) Patent No.: US 8,561,793 B2
(45) Date of Patent: Oct. 22, 2013

(54) CONTAINER WITH RESILIENT MEMBER

(75) Inventor: Lucas Chatelain, Savigny (CH)

(73) Assignee: Philip Morris USA Inc., Richmond, VA (US)

( * ) Notice: Subject to any disclaimer, the term of this patent is extended or adjusted under 35 U.S.C. 154(b) by 183 days.

(21) Appl. No.: 12/547,950

(22) Filed: Aug. 26, 2009

(65) Prior Publication Data

US 2010/0051486 A1 Mar. 4, 2010

(30) Foreign Application Priority Data

Aug. 26, 2008 (EP) ..... 08252825

(51) Int. Cl.
*A24F 15/00* (2006.01)

(52) U.S. Cl.
USPC ..... 206/266; 206/271; 206/817; 206/556; 206/449

(58) Field of Classification Search
USPC ..... 206/266, 271, 804, 817, 556, 449
See application file for complete search history.

(56) References Cited

U.S. PATENT DOCUMENTS

| | | | | |
|---|---|---|---|---|
| 204,040 | A * | 5/1878 | Hewlett | 206/266 |
| 356,244 | A | 1/1887 | Emery | |
| 1,735,324 | A * | 11/1929 | L'Enfant | 206/251 |
| 3,583,625 | A * | 6/1971 | Gero | 206/264 |
| 3,749,234 | A | 7/1973 | Gero | |
| 4,015,769 | A | 4/1977 | Erlich | |
| 4,172,520 | A * | 10/1979 | Gero | 206/265 |
| 5,014,906 | A * | 5/1991 | Gero | 229/123 |
| 6,412,630 | B2 * | 7/2002 | Focke et al. | 206/268 |
| 6,450,329 | B1 * | 9/2002 | Draghetti et al. | 206/252 |
| 7,712,607 | B2 * | 5/2010 | Ghini et al. | 206/268 |

FOREIGN PATENT DOCUMENTS

| | | | |
|---|---|---|---|
| CH | 473012 | A | 5/1969 |
| DE | 19846027 | A1 | 4/2000 |
| GB | 320350 | | 10/1929 |
| WO | WO2006061719 | A | 6/2006 |

OTHER PUBLICATIONS

International Search Report and Written Opinion mailed Feb. 12, 2010 for PCT/EP2009/006031.

European Search Report dated Feb. 2, 2009 for European Application No. 08252825.

* cited by examiner

*Primary Examiner* — J. Gregory Pickett
*Assistant Examiner* — Raven Collins
(74) *Attorney, Agent, or Firm* — Buchanan Ingersoll & Rooney PC

(57) ABSTRACT

A container for consumer goods comprising an outer shell, an inner housing and a resilient member arranged between the outer shell and the inner housing. The inner housing has an opening and is mounted within the outer shell for rotational movement relative thereto between a closed position, in which the opening is covered by the outer shell and an open position in which the opening is at least partially exposed. The inner housing is resiliently biased towards the closed position by the resilient member.

8 Claims, 4 Drawing Sheets

CONTAINER WITH RESILIENT MEMBER

CROSS-REFERENCE TO RELATED APPLICATION

This application claims priority to European Application No. 08252825.8, filed Aug. 26, 2008, the entire content of which is incorporated herein by this reference thereto.

BACKGROUND

A novel container for consumer goods is provided. The Containers are particularly suitable as containers for elongate smoking articles, such as cigarettes.

It is known to package consumer goods in containers formed from folded laminar blanks. For example, elongate smoking articles, such as cigarettes and cigars, are commonly sold in hinge lid packs constructed from one-piece laminar cardboard blanks. However, containers having two portions, a shell and a slide, formed from separate laminar blanks are also known. In such containers, the consumer goods are housed in the slide, which is mounted within the shell for linear or rotational movement relative thereto between a closed position, in which the consumer goods are not accessible, and an open position, in which a consumer may remove the goods from the slide of the container. Such a container is disclosed, for example, in EP-A-1,836,108.

It would be desirable to provide a novel container that can be conveniently opened and closed.

SUMMARY

Provided is a container for consumer goods comprising: an outer shell; an inner housing having an opening, wherein the inner housing is mounted within the outer shell for rotational movement between a closed position, in which the opening is covered by the outer shell and an open position in which the opening is at least partially exposed; and a resilient member arranged between the outer shell and the inner housing, wherein the inner housing is resiliently biased towards the closed position by the resilient member.

The resilient member is a compression spring, which is compressed as the inner housing is moved from its closed position to its open position. The resilient member comprises a laminar sheet having one or more folds therein. The laminar sheet has a non-rectangular shape.

The outer shell comprises an inner wall to which the inner housing is attached such that the inner housing is rotatable about an axis extending across the inner wall of the outer shell. A section of the inner wall is attached to the inner housing, and the section of the inner wall is rotatable along with the inner housing about an axis extending across the inner wall of the outer shell. Also, the outer shell comprises an additional compartment. A cut out is provided in the outer shell.

Also provided is a container for consumer goods comprising: an outer shell; an inner housing mounted within the outer shell and having an opening therein, the inner housing being moveable between a closed position, in which the opening is covered by the outer shell and an open position in which the opening is at least partially exposed wherein the inner housing comprises a lid flap that covers the opening in the closed position, wherein the lid flap is pivotable into a park position inside the outer shell in the open position of the container; and a resilient member arranged between the outer shell and the inner housing, wherein the inner housing is resiliently biased towards the closed position by the resilient member. The lid flap further comprises dust flaps. Preferably, the container contains smoking articles.

DETAILED DESCRIPTION

Figure 1:
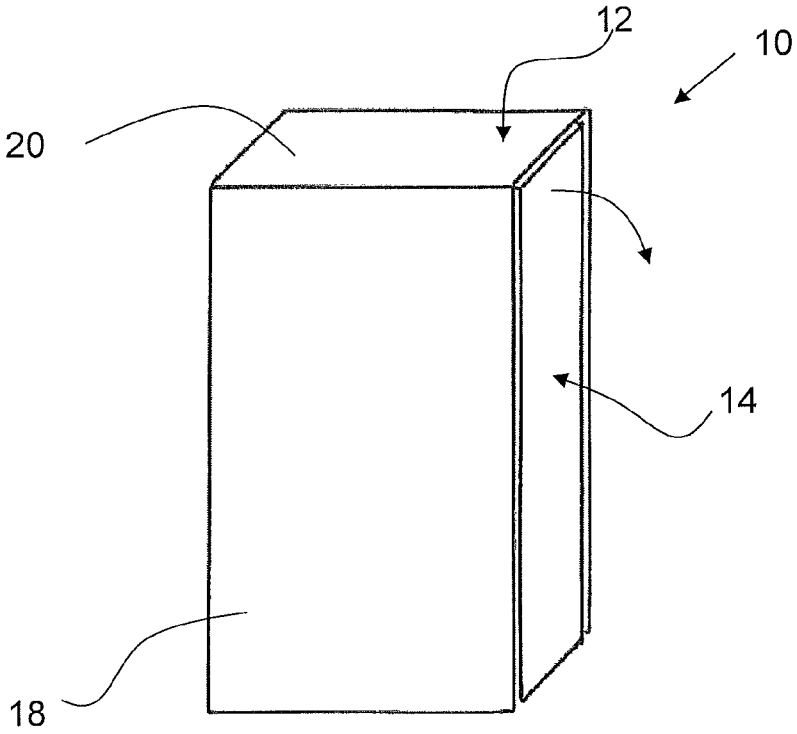
FIG. 1 shows a container according to a first embodiment, with the inner housing in a closed position.

Provided is a container for consumer goods comprising: an outer shell; an inner housing having an opening, wherein the inner housing is mounted within the outer shell for rotational movement between a closed position, in which the opening is covered by the outer shell and an open position in which the opening is at least partially exposed; and a resilient member arranged between the outer shell and the inner housing, wherein the inner housing is resiliently biased towards the closed position by the resilient member.

The container provides an interesting and surprising self-closing effect due to the resilient member. Advantageously, the container may be opened single handed by biasing the inner housing towards the closed position. This leaves the consumer with a free hand to remove the consumer goods from the container while the container simply recloses after being released.

The resilient member of containers is arranged between the outer shell and the inner housing such that movement of the inner housing from the closed position to the open position results in a deformation of the resilient member.

As used herein, the term "deformation" refers to a change of shape or size or both shape and size of the resilient member as a result of applied forces. The deformation may be a result of compressive (pushing) forces, tensile (pulling) forces, bending or torsion (twisting) forces, which will be applied by the consumer in order to move the inner housing from its closed position to its open position. Typically, the force will be applied to the inner housing and transmitted through the inner housing to the resilient member.

Preferably, the resilient member of containers is formed from a material that deforms linearly-elastically for the range of forces typical for opening a container so that when the applied force is removed, the resilient member returns to its original shape and size. As it returns to the original size and shape, the resilient member will force the inner housing back to its closed position.

Advantageously, the presence of the resilient member means that the inner housing will remain in a closed position unless and until the consumer applies sufficient force to open it. This prevents the inadvertent opening of the container and the potential loss of the consumer goods stored inside, for example inside a hand bag. In addition, this ensures that the consumer goods within the container remain as fresh as possible during storage.

The resilient member is preferably a compression spring member, which is compressed by the inner housing as the inner housing moves from the closed position to the open position. A sufficient force must be applied to the inner housing to compress the spring member such that the inner housing is moved to a position in which the opening is at least partially exposed. Once the force has been removed, the compression spring member will revert back to its original shape, thereby returning the inner housing to the closed position.

In a particularly preferred example, the compression spring member is a laminar sheet of, for example, cardboard or plastic, which is folded or corrugated such that movement of the inner housing from the closed position to the open position compresses the folds or corrugations. The material from which the laminar sheet is formed must be sufficiently resilient such that it returns to substantially the original length once the compressive force has been removed.

Alternatively, the resilient means may be an expansion spring member, or a torsion spring member, or any other type of suitable resilient means.

The resilient member may be integral with the outer shell or the inner housing. Alternatively, the resilient member may be adhered to at least one of the outer shell and the inner housing. Alternatively still, the resilient member may be fitted between the outer shell and the inner housing such that it remains in position without the need for adhesion. This may be achieved by the provision of walls or flaps of the outer shell or inner housing, which prevent the movement of the resilient member, or may be due to the friction fit of the resilient member within the space that it occupies in the outer shell.

Depending on the construction of the container, the position of the resilient member in the container, the type of resilient member and the position of the axis of rotation of the inner housing, the force used to open a container may be substantially in the direction of the opening movement of the inner housing, transverse to it or even substantially opposed to the direction of the opening movement of the inner housing.

The outer sleeve may be provided with an opening, which is lined up with the opening in the inner housing when the inner housing is in its open position, so that the consumer goods contained in the inner housing can be accessed.

Preferably, the inner housing is rotatable relative to the outer shell such that in its open position the inner housing projects from a side of the outer shell. This allows for a particularly convenient access to the consumer goods inside the container.

The axis about which the inner housing rotates may be provided by a free edge of one of the walls of the outer shell. For example, the bottom wall of the outer shell may extend only part way across the bottom of the container, such that the inner housing may be rotated about the free edge thereof. In such cases, the inner housing and outer shell are preferably connected about the edge providing the axis of rotation.

In a particularly preferred embodiment of the container, the outer shell comprises an inner wall having a portion to which the inner housing is connected. Preferably, the portion of the inner wall to which the inner housing is connected is itself connected to the remainder of the inner wall about a hinge or fold line extending across the inner wall. This advantageously results in a strong connection between the inner housing and the outer shell, adding stability to the container.

Preferably, containers are arranged such that the movement of the inner housing relative to the outer shell is limited. This is to ensure that the inner housing is not pushed out of the outer shell beyond its open position, thereby reducing the risk of the inner housing becoming separated from the outer shell. For example, the inner housing may be connected to the outer shell, the resilient member, or both. Alternatively, the arrangement of the resilient member may limit the movement of the inner housing relative to the outer shell, or the inner housing may only be moveable within the space inside the outer shell.

Preferably, at least one cut-out is provided in the outer shell of containers. In use, a consumer may advantageously apply a force to the inner housing through the cut-out portion in the outer shell in order to move the inner housing from the closed position to the open position.

In certain embodiments, the outer shell may include an additional compartment, which is suitable for the storage of additional consumer goods. For example, if the inner housing contains a bundle of cigarettes, the additional compartment in the outer shell may contain matches or a lighter. The additional compartment may be provided by a space within the outer shell that is not taken up by the inner housing or the resilient member.

In an alternative embodiment of the container, the container for consumer goods comprises an outer shell, an inner housing mounted within the outer shell and having an opening therein, the inner housing being moveable between a closed position, in which the opening is covered by the outer shell and an open position in which the opening is at least partially exposed; and a resilient member arranged between the outer shell and the inner housing. The inner housing is resiliently biased towards the closed position by the resilient member. Preferably, the inner housing comprises a lid flap that covers the opening in the closed position. The lid flap is pivotable into a park position inside the outer shell in the open position of the container.

Preferably, the lid flap covers the resilient member in the closed position of the container. Also preferably, the lid flap pivots into the outer shell upon opening of the container, thereby still covering the resilient member.

Preferably, the lid flap further comprises dust flaps on the sides. These advantageously cover the opening towards the front and back during the opening and closing movement. The dust flaps aid in preventing a potential contamination of the space housing the resilient member. This ensures the operation of the closing mechanism of the container.

Containers may be formed from blanks of any suitable materials including, but not limited to, cardboard, paperboard, plastic, metal, or combinations thereof. The blanks for forming the inner housing, outer shell and resilient member may be made from the same or different materials. If desired, the outer shell may be at least partially formed from a substantially transparent material. Preferably, the container is formed from one or more folded laminar blanks, more preferably from one or more folded laminar cardboard blanks. Preferably, the cardboard has a weight of between about 100 grams per square meter and about 350 grams per square meter.

Containers find particular application as packs for elongate smoking articles such as, for example, cigarettes, cigars or cigarillos. It will be appreciated that through appropriate choices of the dimensions thereof, containers may be designed for different numbers of conventional size, king size, super-king size, slender or very slender cigarettes.

Through an appropriate choice of the dimensions thereof, containers may also be designed to hold different total numbers of smoking articles, or different arrangements of smoking articles.

The exterior surfaces of containers may be printed, embossed, debossed or otherwise embellished with manufacturer or brand logos, trademarks, slogans and other consumer information and indicia. Alternatively, or in addition, the exterior surfaces of containers may be at least partially covered with lacquer, metallization, holograms, luminescent material, or any other materials that alter the feel, odor or appearance of the container.

Where the inner housing of a container contains a bundle of cigarettes or other elongate smoking articles, the smoking articles are preferably wrapped in an inner liner of, for example, metal foil or metallized paper.

Once filled, the containers may be shrink wrapped or otherwise over wrapped with a transparent polymeric film of, for example, polyethylene or polypropylene in a conventional manner. Where containers are over wrapped, the over wrapper may include a tear tape.

The container will be further described, by way of example only, with reference to the accompanying drawings.

Figure 2:
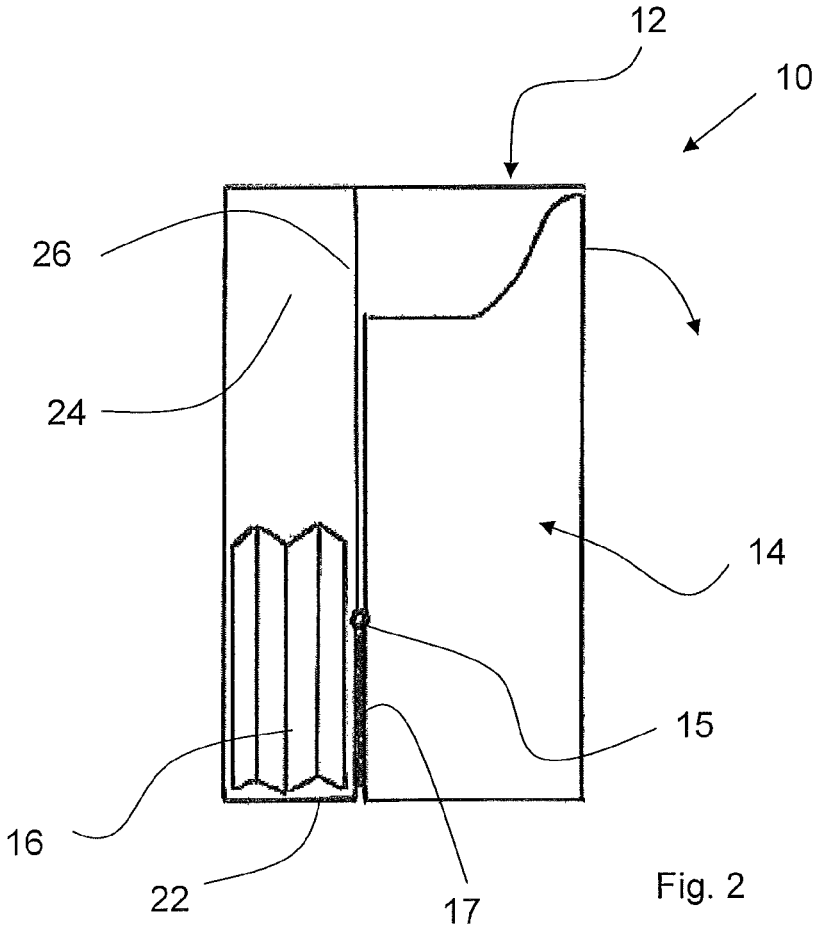
FIG. 2 is a schematic cross section through the container of FIG. 1.

The container 10 according to a first embodiment, shown in FIG. 1, comprises an outer shell 12, an inner housing 14 mounted within the outer shell 12 and a spring member 16 mounted between the inner housing 14 and the outer shell 12 (see FIG. 2). The spring member 16 is formed from a single sheet that has been folded several times in the form of a concertina. This means that at each fold the sheet is folded back on itself to form panels of substantially the same width as each other. The fold lines are substantially parallel to each other and lie substantially vertically when the container is assembled. The inner housing 14 is for housing a bundle of smoking articles (not shown in the figures).

The outer shell 12 is rectangular parallelepipedal in shape and comprises a front wall 18, a back wall opposed to the front wall, a left side wall, a top wall 20 and a bottom wall 22 (see FIG. 2). In order to provide an opening through which the inner housing 14 can be removed from the outer shell 12, the right face of the outer shell 12 is entirely open and the bottom wall 22 extends only a short distance from the left side wall towards the right side wall, only partly covering the lower end of the spring member 16.

As shown in FIG. 2, the outer shell 12 further comprises an inner wall 26 extending from the top wall 20 down towards the bottom side of the outer shell 12. The inner wall 26 is substantially parallel to the left and right side walls and has substantially the same width. The inner wall 26 is positioned a short distance from the left side wall.

The inner wall 26 comprises an upper portion and a lower portion, which are connected about a fold line 15. The upper portion is attached to the opposed front and back walls of the outer shell 12 by means of a pair of tabs (not shown). The lower portion is connected to the inner housing 14 and is pivotable relative to the upper portion of the inner wall 26, about the fold line 15.

Above the spring member 16, between the inner wall 26 and the left side wall of the outer shell 12 is a space 24. This space 24 may be used to house other articles, for example matches or a lighter (not shown). The space 24 may have any convenient separate opening, for example in the left side wall of the outer shell 12 or in the top wall 20 of the outer shell 12.

Figure 3:
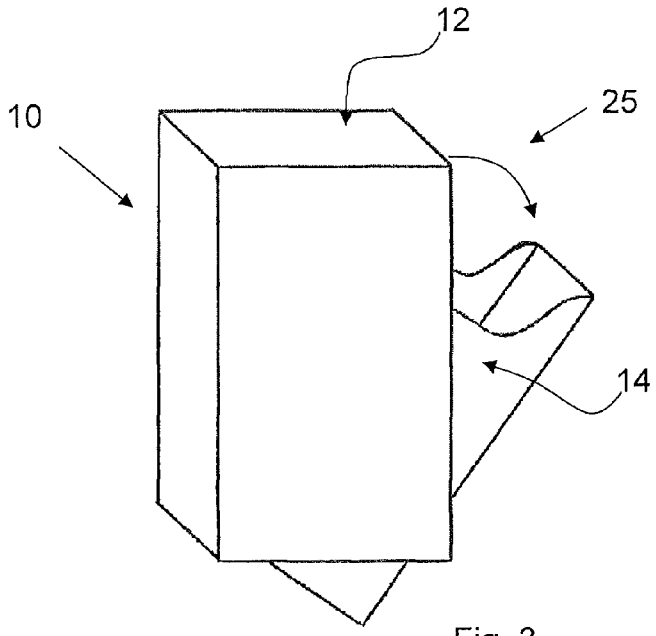
FIG. 3 shows the container of FIG. 1 with the inner housing in an open position.

In order to access the smoking articles within the container 10, the inner housing 14 must be rotated in the direction of the arrow in FIGS. 1, 2, and 3. To do so, the pressure is applied to the lower parts of the side walls of the container 10, which causes the inner housing 14 to pivot out of the outer shell 12. The inner housing 14 pivots about the fold line 15 between the upper and lower portions of the inner wall 26. As the inner housing 14 is rotated out of the outer shell 12, the lower left corner thereof rotates towards the left side wall of the outer shell 12 and the lower part of the spring member 16 is compressed.

FIG. 3 shows the container 10 with the inner housing 14 in an open position, having been rotated by approximately 30 degrees out of the outer shell 12 to create an opening 25 so that the smoking articles in the inner housing 14 can be removed.

As soon as the force is removed or sufficiently reduced, the spring member 16 will revert to its original size and shape, causing the inner housing 14 to spring back to the closed position shown in FIGS. 1 and 2.

Figure 4:
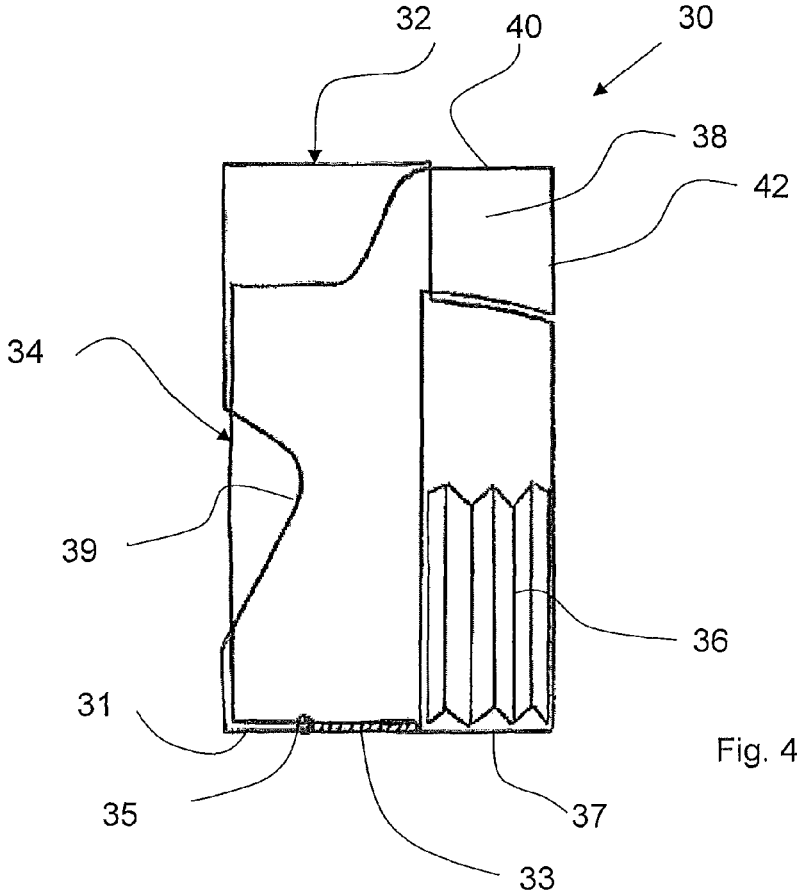
FIG. 4 is a schematic cross section of a container according to a second embodiment, with the inner housing in a closed position.

Container 30 as shown in FIG. 4 comprises an outer shell 32 and an inner housing 34 mounted inside the outer shell. FIG. 4 shows the container 30 with the inner housing 34 in the closed position. The inner housing 34 comprises a hook extension 38 on the upper right corner. This hook extension 38 comprises a front flap and a back flap, an upper right wall 42 and a top wall 40. In the closed position of the container 30, the upper right wall 42 substantially aligns with the right side wall of the outer shell 32 and the top wall 40 aligns with the top wall of the outer shell 32.

The outer shell 32 comprises an opening on the upper right corner that is covered by the hook extension 38 of the inner housing 34. On the left side the outer shell 32 comprises a cut-out 39 extending from the back wall of the outer shell 32 over the left side wall into the front wall of the outer shell 32, exposing the inner housing 32 through the cut-out 39.

The bottom wall of the outer shell 32 comprises a fixed left part 31, a middle flap 33 and a fixed right part 37. The middle flap 33 is hingedly connected to the left part 31 of the bottom wall of the outer shell 32 through a hinge 35. The middle flap 33 is also adhered to the bottom wall of the inner housing 34. The fixed right part 37 of the bottom wall supports a spring member 36 and prevents it from dropping out of the bottom of the container 30. The fixed right part 37 covers only part of the spring member 36 mounted within the outer shell 34, between the right side walls of the inner housing 34 and the outer shell 32, as can be seen in FIG. 5.

Figure 5:
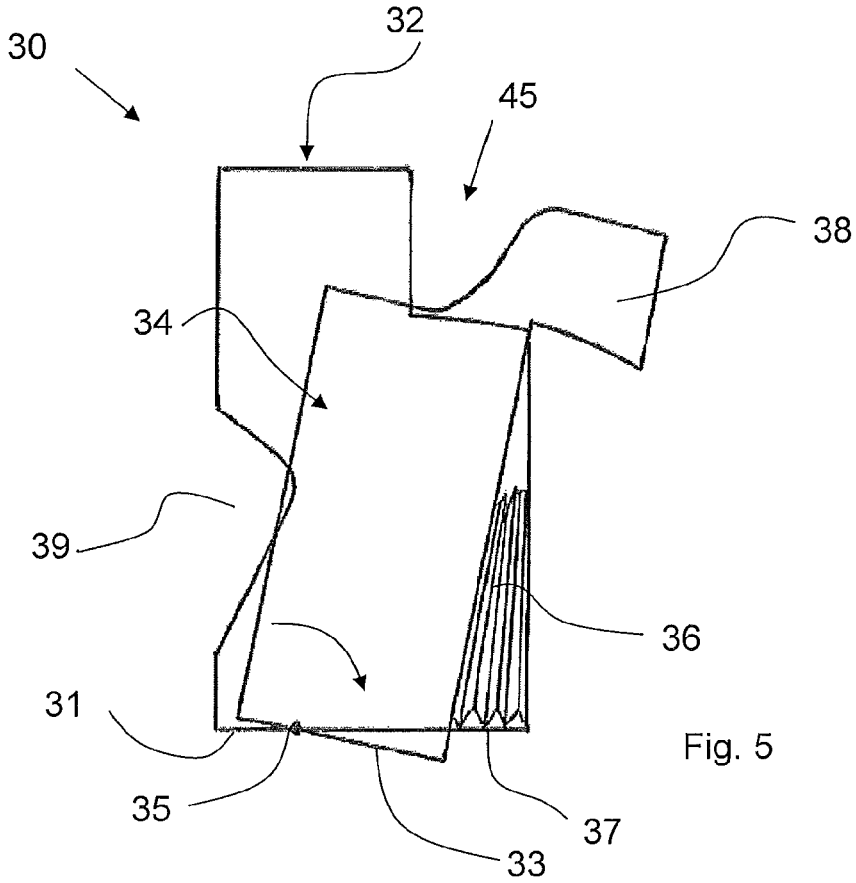
FIG. 5 is a schematic cross section through the container of FIG. 4 in the open position.

In order to access the smoking articles within the inner housing 34, the inner housing 34 must be rotated in the direction of the arrow in FIG. 5. The consumer may apply the necessary force to the left side wall of the inner housing 34 through the cut-out 39 in the outer shell 32. The inner housing 34 pivots about the fold line 35. As the inner housing 34 is rotated out of the outer shell 32, the right wall thereof rotates towards the right side wall of the outer shell 32 and the upper part of the spring member 36 is compressed.

FIG. 5 shows the container 30 with the inner housing 34 in an open position, having been rotated by approximately 30 degrees out of the outer shell 32. The open upper face of the inner housing 34 is exposed through the opening 45 in the upper right corner of the outer shell 32, so that the smoking articles in the inner housing 34 can be removed. The top part of the spring member 36 has been compressed by the inner housing 34.

As soon as the force is removed or sufficiently reduced, the inner housing 34 will spring back to the closed position shown in FIG. 4.

It will be appreciated that there are a number of other ways in which the inner housing can be mounted in the outer shell for rotation relative thereto.

Figure 6:
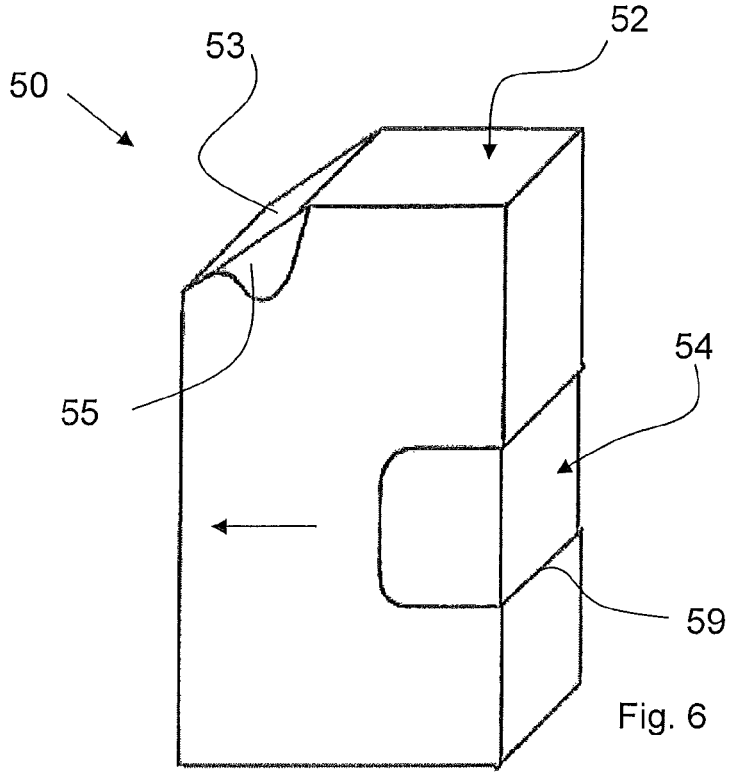
FIG. 6 shows a container according to the a third embodiment, with the inner housing in a closed position.

The container 50 according to a further embodiment is shown in FIG. 6. Container 50 comprises an outer shell 52, an inner housing 54 mounted within the outer shell 52 and a spring member 56 (see FIG. 7) mounted between the outer shell 52 and inner housing 54. The inner housing 54 is for housing a bundle of smoking articles (not shown in the figures).

The outer shell 52 comprises a front wall, a back wall opposed to the front wall, a right side wall 20, a left side wall, a top wall and a bottom wall. A substantially rectangular cut-out 59 is provided at the right side of the outer shell 52, approximately halfway up. The top left corner of the outer shell 52 is cut away to provide an opening through which the inner housing 54 and the smoking articles contained therein may be accessed. The outer shell 52 is substantially rectangular parallelepipedal in shape, but with portions cut away to provide the opening at the top left corner, and the cut-out 59 in the right side. As a result of the cut away corner, the left side wall is of a reduced height compared to the right side wall.

Figure 7:
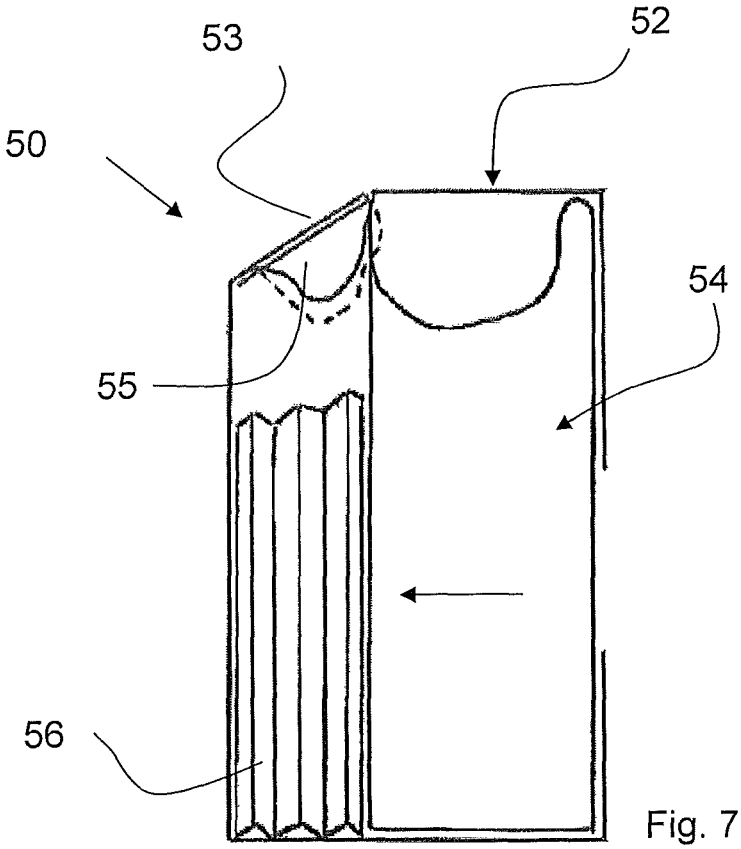
FIG. 7 shows a schematic cross section of the container of FIG. 6.

As shown in FIG. 7, the inner housing 54 comprises a front wall, a back wall opposed to the front wall, a right side wall, a left side wall and a bottom wall. The inner housing 54 is substantially rectangular parallelepipedal in shape, but with a portion cut away at the top end in order to provide an opening through which the smoking articles may be removed. A flap 53 extends from the upper edge of the left side wall of the inner housing 54 and is folded downwards towards the left side of the inner housing 54.

The spring member 56 of the container 50 is formed from a single sheet that has been folded several times in the form of a concertina. This means that at each fold the sheet is folded back on itself to form panels of substantially the same width as each other. The fold lines are substantially parallel to each other and lie substantially vertically when the container is assembled. The sheet from which the spring member 56 is formed has a non-linear upper edge. As a result, the height of the panels formed by the folding of the sheet is greater at the right side of the spring member 56 than at the left side.

Preferably, the spring member 56 fills the entire space between the left side wall of the outer shell 52 and the left side wall of the inner housing 54. This means, that it has the same height on its left side as the left wall of the outer shell 52 and has the same height on its right side as the left wall of the inner housing 54. Advantageously, that way the spring member 56 supports the lid flap 53 from below.

FIGS. 6 and 7 show the container 50 with the inner housing 54 in the closed position. In this position, the inner housing 54 is mounted inside the outer shell 52 at the far right side thereof, with the opening in the inner housing 54 covered by the top wall of the outer shell 52. s can be seen from FIG. 7, the lid flap 53 extends from the upper edge of the left side wall of the inner housing 54 to the left side wall of the outer shell 52, at an angle of approximately 45 degrees to the left side wall of the inner housing 54. The spring member 56 is also mounted within the outer shell 52, between the left side walls of the inner housing 54 and the outer shell 52 and beneath the lid flap 53. The lid flap 53 therefore covers the spring member 56, so that it is not visible to the consumer. Towards the front and the back of the container 50, the lid flap 53 comprises dust flaps 55 that lie against the front and back walls of the outer shell 54.

In order to access the smoking articles within the inner housing 54, the inner housing 54 must be pushed towards the left side of the container, in the direction shown by the arrow in FIG. 7. The consumer may apply the necessary force to the right side wall of the inner housing 54, through the cut-out 59 in the outer shell 54. As the inner housing 54 is pushed towards the left side of the outer shell 54, the spring member 56 is compressed. At the same time, the lid flap 53 is pivoted downward, sliding between the inside of the left side wall of the outer shell 52 and the left side of the spring member 56, thus opening the container 50.

As soon as the force is removed or sufficiently reduced, the spring member will revert to its original shape, causing the inner housing 54 to spring back to the closed position shown in FIGS. 6 and 7, pulling along the lid flap 53 in order to reclose the upper left opening in the outer shell 52.

In this specification, the word "about" is often used in connection with numerical values to indicate that mathematical precision of such values is not intended. Accordingly, it is intended that where "about" is used with a numerical value, a tolerance of ±10% is contemplated for that numerical value.

While the foregoing describes in detail a preferred container with a resilient member and methods of making with reference to a specific embodiment thereof, it will be apparent to one skilled in the art that various changes and modifications may be made to the container and equivalents method may be employed, which do not materially depart from the spirit and scope of the container described herein. Accordingly, all such changes, modifications, and equivalents that fall within the spirit and scope of the containers as defined by the appended claims are intended to be encompassed thereby.

I claim:

1. A container for consumer goods comprising:

an outer shell;

an inner housing having an opening, wherein the inner housing is mounted within the outer shell for rotational movement between a closed position, in which the opening is covered by the outer shell and an open position in which the opening is at least partially exposed, wherein the inner housing comprises a hook extension on an upper right corner of the inner housing, the hook extension including a front flap, a back flap, an upper right wall and a top wall and wherein in a closed position the upper right wall substantially aligns with a right side wall of the outer shell and the top walls substantially aligns with the top wall of the outer shell; and a resilient member arranged between the outer shell and the inner housing, wherein the inner housing is resiliently biased towards the closed position by the resilient member throughout rotation movement away from the closed position, the resilient member is compressible and is compressed as the inner housing is moved from its closed position to its open position, the compressible resilient member consisting essentially of a first laminar sheet having one or more folds therein and the container comprises a second laminar sheet.

2. A container according to claim 1 wherein the first laminar sheet has a non-rectangular shape.

3. A container according to claim 1 wherein the outer shell comprises an inner wall to which the inner housing is attached such that the inner housing is rotatable about an axis extending across the inner wall of the outer shell.

4. A container according to claim 3 wherein a section of the inner wall is attached to the inner housing and wherein the section of the inner wall is rotatable along with the inner housing about an axis extending across the inner wall of the outer shell.

5. A container according to claim 1 wherein the outer shell comprises an additional compartment.

6. A container according to claim 1 wherein a cut out is provided in the outer shell.

7. A container according to claim 1 comprising smoking articles.

8. A container according to claim 1 wherein each laminar sheet is a cardboard laminar sheet.

* * * * *